United States Patent [19]

Dickinson

[11] 3,935,710

[45] Feb. 3, 1976

[54] GLAND STEAM REHEATER FOR TURBINE APPARATUS GLAND SEALS

[75] Inventor: John D. Dickinson, Swarthmore, Pa.

[73] Assignee: Westinghouse Electric Corporation, Pittsburgh, Pa.

[22] Filed: July 18, 1974

[21] Appl. No.: 489,637

[52] U.S. Cl. ..... 60/657; 277/15

[51] Int. Cl.[2] ..... F01B 31/10

[58] Field of Search ..... 60/646, 657; 277/15

[56] References Cited

UNITED STATES PATENTS 3,062,553 11/1962 Juzi ..... 60/646 X

*Primary Examiner*—Allen M. Ostrager

*Attorney, Agent, or Firm*—George M. Medwick

[57] ABSTRACT

A reheater arrangement for providing steam within a predetermined temperature and pressure range for turbine rotor gland seal devices. Steam taken from a steam source is divided by suitable control means into a first and a second portion. The first portion of steam is directed into the tubes of a shell and tube reheater element while the second portion is throttled to an appropriate pressure usable in the glands. The throttled second portion of the steam is then passed through the shell of the reheater element where heat from the first portion from the source of steam is exchanged with the second throttled portion of the steam to provide steam at the appropriate temperature and pressure for use in the gland seals.

7 Claims, 2 Drawing Figures

GLAND STEAM REHEATER FOR TURBINE APPARATUS GLAND SEALS

BACKGROUND OF THE INVENTION

1. Field of the Invention

This invention relates to steam turbine systems, and in particular, to a reheater system for providing steam within an appropriate temperature and pressure range for use in turbine rotor gland seals.

2. Description of the Prior Art

Gland seals are utilized to provide an effective seal interface arrangement between a rotating and a stationary element and are most commonly utilized in the steam power generation art to provide seals between a rotating shaft and a stationary steam turbine housing. A gland seal in a turbine apparatus utilizes a quantity of pressurized steam to prevent leakage of steam from within the turbine apparatus to atmosphere or to insure no leakage of atmosphere air past the seal and into the turbine housing.

Whatever the particularized application, however, it is well known that steam utilized in the gland seals in a steam turbine apparatus should be within a predetermined temperature and pressure range. This is required since exposure of the elements of the turbine apparatus to extreme temperature differentials could lead to metal fatigue and premature failure.

Analytical investigation has determined, for example, that steam used for gland seals should be within 300°F of the turbine metal. Repeated use of steam having temperature differentials in excess of this standard causes severe metal fatigue which could result in premature failure.

In the prior art, where turbine apparatus is used for fossil fueled power plants, it is usually a simple matter to lower the temperature and pressure of the steam used in the glands. However, where steam required for utilization in the glands must be increased in temperature, the problem becomes more difficult. The prior art discloses several methods for increasing the temperature of steam used in the gland seals such as heaters using electric heating elements, but no efficient and effective method is available that is also economical.

It is desirable, therefore, to provide an effective, economical system whereby steam used in the gland seals for a turbine apparatus can be provided having both the requisite temperature and pressure needed for the gland use so that damage to the glands and the turbine metal is avoided. In addition, it is imperative that an efficient, economical system to provide steam for glands at temperatures required for either hot or cold starts be available.

SUMMARY OF THE INVENTION

This invention discloses an arrangement whereby a single high pressure source is utilized to provide steam for use in the gland seals of the turbine apparatus. Steam is drawn from the source at the appropriate temperature and pressure of the source and is bifurcated through the use of suitable control means into a first and a second portion. The first portion of steam from the source is introduced into the tubes of a shell and tube reheater element. The temperature of the steam introduced into the tubes of the reheater is controlled by suitable first control means. The second portion of steam is throttled by second control means to the desired predetermined pressure required by the glands. The throttled steam is then introduced into the shell of the reheater element and is heated by the first portion of steam in the tubes. Steam at the appropriate pressure and temperature is introduced into the glands.

It is an object of this invention to provide a single steam source adapted to provide steam at a desired pressure and within a desired temperature range for any starting condition of a turbine apparatus.

It is a further object of this invention to provide a single steam source and to utilize that single steam source to provide steam at the appropriate pressure and temperature for use in the gland seals. It is a still further object of the invention to dispose a single steam source and to use the temperature and pressure of that steam source both to provide sealing steam for the gland seals and to heat the sealing steam to the appropriate temperature for utilization by the gland seals.

BRIEF DESCRIPTION OF THE DRAWINGS

The invention will be more fully understood from the following detailed description of an illustrative embodiment taken in connection with the accompanying drawings, in which.

DESCRIPTION OF THE PREFERRED EMBODIMENT

Figure 1:
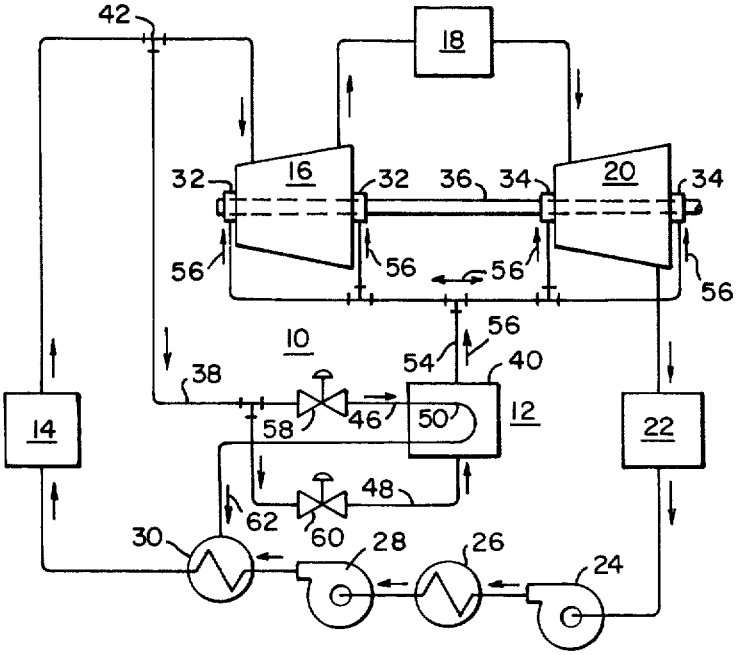
FIG. 1 is a diagrammatic view of a nuclear steam turbine power plant utilizing a gland steam reheater taught by this invention; and, FIG. 2 is a diagrammatic view of a gland steam reheater taught by this invention.

Throughout the following description, similar reference characters refer to similar elements in all figures of the drawings.

Referring now to FIG. 1, a diagrammatic view of a nuclear steam turbine power plant 10 utilizing a steam gland reheater 12 taught by this invention is shown. Although FIG. 1 illustrates the steam gland reheater 12 being utilized with a nuclear steam power plant, it is to be understood that the gland steam reheater 12 taught by this invention is equally applicable to provide steam at the appropriate temperature and pressure for utilization with the pressurized steam gland seals of a turbine in a fossil fueled power plant.

The nuclear steam power plant 10 comprises a closed loop series connection having a steam generator element 14 connected to a high pressure turbine element 16. Steam produced by the steam generator element expands through the high pressure turbine element 16 and is conducted therefrom into a combined moisture separator and reheater element 18. The moisture separator and reheater element 18 has the combined function of eliminating moisture from the steam conducted thereto from the high pressure turbine element and raising the temperature of the now dried steam to a predetermined level. Steam exiting the moisture separator and reheater element 18 is conducted into a low pressure turbine element 20 and expands therethrough and is returned to the liquid state in a condenser element 22. Although FIG. 1 illustrates only one low pressure turbine element 20 in the nuclear steam power plant 10, it is well known to those skilled in the art that two, three, or more low pressure turbine elements may be cascaded in a nuclear steam turbine power plant. The liquid from the condenser 22 is returned to the steam generator element 14 to complete the closed loop nuclear steam power plant 10 through a condensate pump 24, at least one low pressure feedwater heater 26, a boiler feed pump 28 and at least one high pressure heater element 30.

If a fossil fueled power plant were to be utilized, it is well known that water is transformed into steam in a boiler element which is connected in series to the high pressure turbine element of a steam turbine. Steam produced by the boiler element expands through the high pressure turbine element and is conducted through a reheater section in the boiler element, and then to an intermediate pressure and a low pressure turbine element. Thus, instead of having a combined moisture separator and reheater element 18 as in the nuclear steam power plant, the fossil fueled plant has a reheater section disposed within the boiler element.

Both the high pressure turbine element 16 and the low pressure turbine element 20 have gland seals 32 and 34, respectively, surrounding a rotating shaft 36 having rotating elements thereon disposed within each turbine element. It is well known that steam supplied to the gland seals should be within 300°F of the temperature of the metal of the rotating element in the gland areas in order to avoid eventual formation of thermal fatigue cracks in the rotating element. It is often difficult and expensive to make available steam supplies that will satisfy the 300°F maximum allowable temperature differential. In some instances, such as the "cold start", steam at a much cooler temperature than is available from the steam source must be utilized in the gland seals. It is therefore a relatively simple matter to throttle steam from the available steam source to the appropriate pressure required by the gland seals and to desuperheat the steam so that it is within the predetermined temperature range so that no damage occurs to the metal of the rotating element.

However, for a "hot start," it is relatively more difficult to heat the steam to a predetermined temperature so that the steam supplied to the glands from the steam source is hot enough to prevent the eventual formation of the metal fatigue cracks within the rotating element.

The prior art, in fossil fueled plants, utilized several steam sources to provide steam to the turbine gland seals at the predetermined temperatures required for the various starting conditions. A fossil fueled power plant using a 3,500 p.s.i.a. boiler, utilizes the main boiler, the high pressure turbine exhaust and an auxiliary boiler as sources to provide sealing steam to the turbine glands under various operating conditions of the turbine such as "cold start," "hot start," and normal operation, when the turbine generator unit is delivering electrical power to the utility power system. It is apparent that such a system utilizing several steam sources is expensive and inefficient. Also, it may not always be possible to observe the 300°F temperature differential limit.

Figure 2:
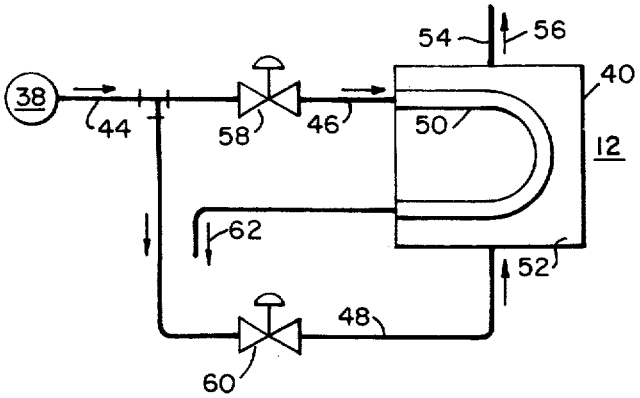

Referring now to FIG. 2, a diagrammatic view of a gland steam reheater 12 taught by this invention and utilized to provide steam within a predetermined pressure and temperature range to the gland seal system of a nuclear steam turbine power plant is illustrated. In FIG. 2, the gland steam reheater 12 comprises a steam source 38 connected through appropriate control means which will be described more fully herein to a shell and tube reheater element 40. The steam source 38 can be any available high pressure steam source within the power plant system. In a nuclear steam power plant 10, the steam source for the gland steam reheater 12 is, as shown in FIG. 1 at reference numeral 42, the steam from the steam generator element 14.

However, if the invention were disposed within a fossil fueled power plant, the source of steam for the gland steam reheater 12 could be an intermediate pressure zone of a drum-type boiler element disposed within the boiler element itself or, for cold or hot starts in power plants using supercritical boilers, from the flash tank of the startup cycle.

Referring again to FIG. 2, the steam source 38 provides, in a nuclear steam power plant, a source of essentially dry and saturated steam at a pressure of 1025 p.s.i.a. Steam from the steam source 38 is conducted through a first conduit 44 which bifurcates into a first branch 46 and a second branch 48. The first branch 46 is connected to the tube members 50 within the shell and tube reheater element 40. The second branch 48 is connected to the shell element 52 of the tube and shell reheater element 40. A second conduit 54 conducts steam at a predetermined temperature and pressure to the gland seals 32 and 34 (FIG. 1) of the high pressure turbine element 16 and the low pressure turbine element 20, respectively, the flow to the gland seals being indicated by reference numeral 56.

Suitable control means, such as a first control valve 58 are disposed within the first branch 46. Similarly, control means, such as a second control valve 60 are disposed within the second branch 48 of the gland steam reheater system 12. The operation of the gland steam reheater system 12 is as follows:

Steam from the steam source 38 is conducted through the first conduit 44 and bifurcates into the first branch 46 and the second branch 48. The first control valve 58 throttles steam from the steam source 38 to a predetermined pressure level and admits the steam so throttled into the tube elements 50 of the shell and tube reheater 40. It is well known to those skilled in the thermodynamic art that the heat exchange capacity of steam, is dependent upon the pressure of that fluid. It is therefore apparent that the amount of heat able to be transferred within the shell and tube reheater element 40 is directly related to and controllable by the first valve 58.

Steam from the steam source 38 within the second branch 48 is throttled by the second control valve 60 to the appropriate predetermined pressure required by the gland seal systems 32 and 34. Usually, steam for the gland seal systems must be approximately 18 p.s.i.a. Thus, the second valve 60 throttles the high pressure wet, or dry and saturated steam, produced by the steam source 38 to the predetermined pressure level suitable for use in the gland seals. However, as is also well known to those skilled in the thermodynamic art, throttling reduces not only the pressure of the steam, but also the temperature. Thus, although the steam within the second branch 48 is at a suitable pressure for use within the gland seal system, its temperature is below the predetermined range of temperatures for use within the gland seal systems.

Since, however, the second branch 48 is connected directly into the shell element 52 of the shell and tube reheater 40, steam in the second branch 48 which has been throttled by the second control valve 60 is introduced into the shell 52 of the reheater element 40. Through well known thermodynamic heat exchange processes, throttled steam from the second branch 48 obtains heat from the steam from the first branch 46 which is disposed within the tubes 50 of the reheater element 32. Thus, the throttled steam having the predetermined pressure for utilization in the gland seal systems is heated to a predetermined temperature within the range of temperatures acceptable for use within the gland seals.

Steam at the predetermined temperature and pressure level is then conveyed by second conduit 54 into the appropriate gland seals as illustrated by reference arrows 56 (FIG. 1). The condensed steam within the tubes 50 of the reheater element 40, which has given its heat of vaporization to the throttled steam introduced into the shell 52 of the reheater element 40, is then conducted to an appropriate drain as illustrated by reference numeral 62 and then to an appropriate high pressure heater 30 where excess heat contained in the condensate is used to raise the temperature of the feedwater returning to the steam generator 14 (FIG. 1).

It is thus seen that a gland steam reheater element 12 as taught by this invention utilizes steam from a single steam source 38 having a source temperature and pressure associated therewith, and bifurcates that steam flow into appropriate control branches 46 and 48. One of the bifurcated steam branches flows through a first control valve 58 and is throttled to a predetermined pressure level before being introduced into the tubes of the reheater element 40. In this way, the heat transfer capability of the first portion of steam from the steam source is controlled. The second bifurcated branch of steam passes through the second control valve 60 and is throttled to appropriate pressure for use in the gland seals. However, the steam so throttled to the appropriate pressure is not within the temperature requirements of steam for use in the gland steam system. Thus, steam in the second bifurcated branch is introduced into the reheater element 40 and takes the heat of vaporization from the steam disposed within the tubes 50 of the reheater 40. Thus, the pressure of the steam from the steam source is throttled to the appropriate gland pressure by the second control valve 60 and the steam so throttled is heated again to a predetermined temperature level dependent upon the pressure of the steam introduced into the tubes 50 of the reheater element 40 through the first control valve 58.

Disposition of a gland steam reheater 12 taught by this invention permits one steam source to provide the steam at a predetermined temperature and pressure level for utilization within the steam gland seal systems. Steam taken from the single steam source provides steam at an appropriate pressure and temperature for use in the steam gland seal system. Steam from the single steam source both provides steam throttled to the appropriate pressure and also reheats the steam to the appropriate temperature for use within the gland steam system.

I claim as my invention:

1. A gland seal system for a steam turbine power plant comprising:

a gland seal, single steam supply means for providing steam to said gland seal, said supply means providing steam to said gland seal at a pressure and a temperature within a predetermined range of pressures and temperatures, said single steam supply means comprising a steam source producing a predetermined volume of steam at a predetermined pressure and temperature, a shell and tube heater element connected to said steam source, first control means for diverting steam from said source into said tube members of said heater element, said control means regulating the pressure and the heat exchange capacity of said steam within said tube elements, second control means diverting a portion of said steam from said source into said gland seal, said steam introduced into said gland seal passing through said shell of said heater element, the pressure of said steam entering said gland seal being regulated by said second control means, the temperature of said steam entering said gland seal being regulated by and dependent upon the temperature and pressure of the steam within said tubes of said heater element.

2. The gland seal system of claim 1, wherein said first control means comprises a first valve device, and said second control means comprises second valve device.

3. The gland seal system of claim 2, wherein said steam turbine power plant is a nuclear fuel power plant having, in series, a steam generator element, a high pressure turbine element, a low pressure turbine element, a moisture separator-reheater element disposed between said turbine elements, and a condenser element, and wherein, said steam source comprises steam taken from a point between said steam generator element and said high pressure turbine element.

4. The gland seal system of claim 1, wherein said steam turbine power plant has disposed therein a reheater element, said first control means comprises a first valve device, said second control means comprises a second valve device, and further comprising, a conduit connected between said shell and tube heater element and said reheater element, said conduit conducting to said reheater element steam diverted from said steam source into said tube members.

5. The gland seal system of claim 1, further comprising a conduit disposed between said shell and tube heater element and said steam source, said conduit having a first branch and a second branch therein, said first branch being connected to said tube members of said shell and tube heater element, said second branch being connected to said shell member of said shell and tube heater element.

6. The gland seal system of claim 5, wherein said first control means comprises a valve, said valve being connected within said first branch of said conduit.

7. The gland seal system of claim 6, wherein said second control means is a valve, said valve being connected within said second branch of said conduit.

* * * * *